US005364015A

United States Patent [19]

Hirschey

[11] Patent Number: 5,364,015

[45] Date of Patent: Nov. 15, 1994

[54] BOX WITH SIMULATED LOOSE WRAP

[75] Inventor: Urban C. Hirschey, Carthage, N.Y.

[73] Assignee: Climax Manufacturing Company, Castorland, N.Y.

[21] Appl. No.: 115,887

[22] Filed: Sep. 1, 1993

[51] Int. Cl.[5] ..... B65D 5/62

[52] U.S. Cl. ..... 229/116.5; 229/87.18; 229/87.19; 229/175; 229/923

[58] Field of Search ..... 229/40, 87.18, 87.19, 229/172–176, 923

[56] References Cited

U.S. PATENT DOCUMENTS

| | | | |
|---|---|---|---|
| 1,364,897 | 1/1921 | Smith | 229/40 |
| 1,402,259 | 1/1922 | Smith | 229/40 |
| 1,437,274 | 11/1922 | Smith . | |
| 1,591,061 | 7/1926 | Smith . | |
| 1,755,694 | 4/1930 | Keppler | 229/175 |
| 1,762,704 | 6/1930 | Smith | 229/40 |
| 2,143,763 | 1/1939 | Claff | 229/40 |
| 2,207,567 | 7/1940 | Warner . | |
| 2,334,425 | 11/1943 | Lowey | 229/175 |
| 2,479,456 | 8/1949 | Arthur . | |
| 2,769,588 | 11/1956 | Beck . | |
| 3,260,359 | 7/1966 | Willhite . | |
| 3,381,878 | 5/1968 | Dewhurst | 229/175 |
| 3,391,856 | 7/1968 | Siegler . | |
| 3,394,867 | 7/1968 | Gregg . | |
| 3,443,739 | 5/1969 | Adams, Jr. . | |
| 3,460,738 | 8/1969 | Adams et al. . | |
| 3,489,333 | 1/1970 | Culberg et al. . | |
| 3,499,598 | 3/1970 | Foley, Jr. et al. . | |
| 3,679,120 | 7/1972 | Rubin . | |
| 3,790,064 | 2/1974 | Kramer . | |
| 3,790,069 | 2/1974 | Straccamore . | |
| 3,807,623 | 4/1974 | Paige . | |
| 3,829,005 | 8/1974 | Hackenberg et al. . | |
| 3,833,164 | 9/1974 | Dagostine . | |
| 3,837,561 | 9/1974 | Rubin . | |
| 4,005,814 | 2/1977 | Foster | 229/87.19 |
| 4,193,533 | 3/1980 | Schulman | 229/176 |
| 4,765,535 | 8/1988 | Michetti . | |
| 4,967,952 | 11/1990 | Roessiger . | |
| 5,044,547 | 9/1991 | Hartman | 229/175 |
| 5,211,330 | 5/1993 | Frey | 229/175 |

*Primary Examiner*—Gary E. Elkins

*Attorney, Agent, or Firm*—Harris Beach & Wilcox

[57] ABSTRACT

A folding box of the type having a pair of telescoping box members, at least one which is formed from a composite blank including a sheet of foldable stiff material and a sheet of flexible material attached to the stiff sheet, and the stiff material forming a first surface and the flexible material forming a second surface. Each box member comprises a base panel having a pair of opposed side edges and a pair of opposed end edges; a pair of end panels, each having a first section connected to an end edge of the base panel, a third section defined by a free edge and a second section that is intermediate the first and third sections and connected along a first fold line to the first section and along a second fold line to the third section, with the free edge, end edge, first fold line and second fold line all being mutually parallel. Also, there are a pair of side panels, each having a section connected to a side edge of the base panel along a side fold line, and a side panel side edge; a flap attached to each end of each of side panel along a flap fold line so that when each flap is folded it rests against the first and second sections of one of the end panels and is sandwiched therebetween. The third section of the end panel is retained against a first surface of the base panel.

9 Claims, 4 Drawing Sheets

BOX WITH SIMULATED LOOSE WRAP

BACKGROUND OF THE INVENTION

1. Field of the Invention

This invention relates to folding boxes. More particularly this invention relates to folding telescoping gift boxes which simulate the appearance of loose wrapped or set-up boxes.

Boxes for containing purchased items are usually provided by department stores as a service for customers. When the item is intended to be presented as a gift, the customer usually desires that the box be attractively wrapped so that additional effort by the customer is not needed. When purchasing gift items at finer department stores, customers have come to expect that the appearance of the gift box will reflect the quality of the gift. The highest quality of gift boxes are considered to be either those which are wrapped in the entirety once the gift item has been enclosed within the box or set-up boxes which comprise a pair of telescoping boxes which have been setup by the box manufacturer by taping the corners of the box and covering the top section or both sections with paper or other attractive flexible material.

Each of these alternatives has its drawbacks, however. When boxes must be gift wrapped at the store, valuable personnel time is required; this is true whether the job is done by cashiers or by special gift wrap clerks. In larger department stores the services of two or three people may be dedicated to this task alone. Furthermore lines may form awaiting this service, especially before holidays such as Christmas, Mother's Day and Valentine's Day. Customers who have just waited in line to purchase an item do not have their mood improved by being required to wait in a second line in order to have a gift wrapped. Nor, in the alternative, do they appreciate having their time waiting for sales personnel to ring up purchases, extended by waiting for other customers' gifts to be wrapped.

The use of set-up boxes helps alleviate the personnel and waiting problems, but does have its own drawbacks. Set-up boxes are strong and attractive and thus are highly desirable for presenting quality gifts. However these boxes are also bulky, taking up far more space than a folded box. Thus, with a sizeable inventory, especially as may be needed during holiday seasons, considerable floor space must be dedicated to the storage of these boxes, floor space which could be put to better use holding merchandise inventory. In addition, bulky items require extra handling when being transported either within or without the store because the amount transported is limited by size rather than weight. Also, there is considerable breakage of these boxes during transportation and storage studies have shown this to be in the amount of between 16 and 20 percent. Furthermore, those gift recipients who choose to retain gift boxes for reuse find these set-up boxes hard to store, offsetting their desirable appearance with undesirable impracticalities.

It has therefore long been a goal in the art to provide folding boxes which combine their inherent advantage of compactness with the quality physical appearance of loose wrapped set-up boxes.

2. Description of the Prior Art

A number of loose wrap simulating gift boxes are found in the prior art. These generally are comprised of composite blanks which include a sheet of stiff but foldable material, such as paperboard, attached to a sheet of flexible decorative material, such as paper or foil. Many of these boxes have overlapping exterior flaps and thus simulate boxes that have been wrapped after enclosing the gift. Among other box configurations, the ones that most closely simulate the exterior appearance of telescoping loose wrapped gift boxes include U.S. Pat. No. 2,769,588 to Beck, U.S. Pat. No. 4,765,535 to Michetti, U.S. Pat. Nos. 3,679,210 and 3,837,561. However the boxes of the prior art are difficult to assemble into the set-up structure. They frequently require that the assembler properly fold diagonal webs and/or that segments derived from the end and side panels be overlapped in a specific order. This means that new personnel must be trained in their assembly and that even experienced personnel may take an inordinate amount of time to set up the boxes. During busy periods this means customer waits, the hiring and training of additional personnel and/or overtime wages. Cutting the time needed for assembly of boxes is thus highly desirable from the retailer's viewpoint.

Furthermore, while all these boxes may present an elegant exterior appearance, this impression is dispelled upon removing and inverting the uppermost telescoping unit. The interior of the boxes of the prior art does not give the same elegant impression as does the exterior. This may be due to overlapping flaps or it may be due to a discontinuous or stepped line of the decorative wrapping. In either case the box interior patently shows its origin as a folding rather than a set-up box.

Moreover, in the prior art, a cut edge of decorative flexible wrap affixed to the stiff foldable material is frequently exposed as a box edge and detracts from the desired elegant appearance of the box.

SUMMARY OF THE INVENTION

It is therefore a primary object of the present invention to provide a telescoping folding decorative box which simulates a set-up box formed of paperboard and covered with flexible decorative material.

It is a further object of the present invention to provide a telescoping folding decorative box which simulates a set-up box formed of paperboard and covered with flexible decorative material that can be rapidly assembled.

It is still another object of the present invention to provide a telescoping folding decorative box which simulates a set-up box formed of paperboard and covered with flexible decorative material to can be easily assembled.

It is yet a further object of the present invention to provide a telescoping folding decorative box which simulates both externally and internally a set-up box formed of paperboard and covered with flexible decorative material.

These and other objects of the present invention are attained by a folding box of the type having a pair of telescoping box members, with at least one of the members being formed from a composite blank including a sheet of foldable stiff material and a sheet of flexible material attached to the stiff sheet, and the stiff material forming a first surface and the flexible material forming a second surface. At least one box member comprises a base panel having a pair of opposed side edges and a pair of opposed end edges; a pair of end panels, each end panel having a first section connected to an end edge of the base panel, a third section defined by a free edge and a second section that is intermediate the first and third sections and connected along a first fold line to the first section and along a second fold line to the third section, with the free edge, end edge, first fold line and second fold line all being mutually parallel. Also, there are a pair of side panels, each side panel having a section connected to a side edge of the base panel along a side fold line, and having a side panel side edge; a flap attached to each end of each of side panel along a flap fold line so that when each flap is folded along the flap fold line it rests against the first and second sections of one of the end panels and is sandwiched therebetween; and retaining means for retaining the third section of the end panel against a first surface of the base panel.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

The present invention furnishes a means for providing a gift package with a simulated overwrap that can be formed from a pair of essentially flat carton blanks which may easily and speedily be erected into telescoping members at least one of which has decorative paper attached to one side thereof and is folded in such a manner as to create the appearance both when closed and when opened, of a set-up box.

Figure 1:
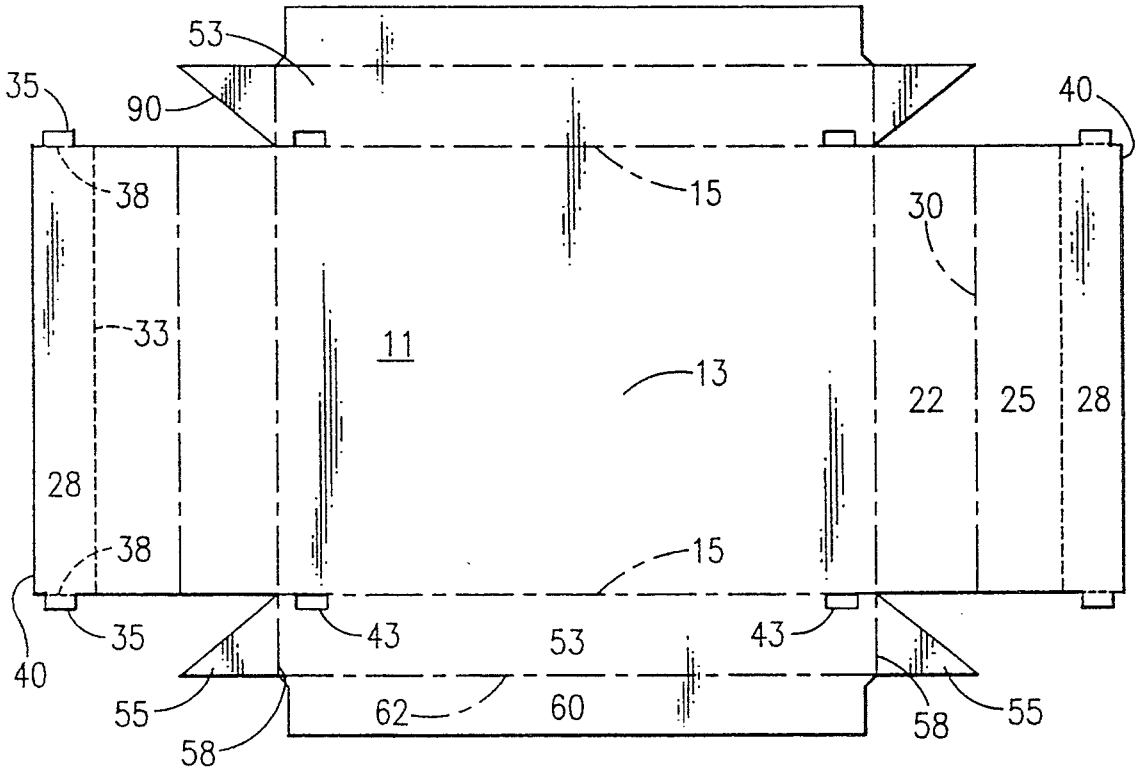
FIG. 1 is a plan view of a first embodiment of foldable paperboard cut for use in forming a box member embodying features of the present invention.

Referring to the drawings for a better understanding of the invention, it will be seen that each half of the telescoping box can be formed of a complex comprising stiff foldable material such as paperboard, as indicated in FIG. 1. The paperboard may be complexed together with flexible decorative material such as paper as is shown in FIG. 2 to form the top section of the box only or, alternatively, both for top and bottom box sections.

Figure 2:
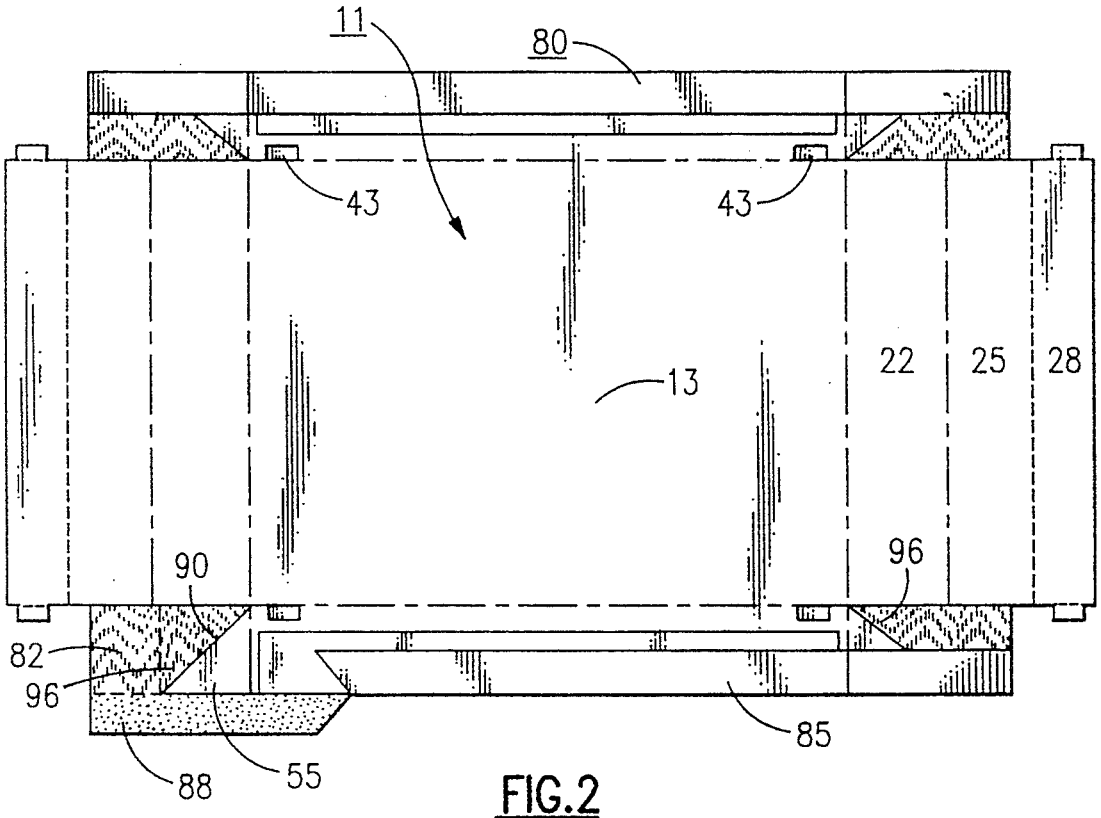
FIG. 2 is a plan view of foldable paperboard of FIG. 1 with a portion of the flexible decorative material attached thereto cut away.

As is clearly seen in FIGS. 1 and 2, the paperboard blank 11 contains a base wall or panel 13 that is substantially rectangular in shape. Adjacent the base wall 13 are two end panels 20,20 and two side panels 50,50. The end panels 20,20 are foldably joined to the end edges of base panel 13 along fold lines 18,18. The side panels 50,50 are foldably joined to the side edges of base panel 13 along fold lines 15,15.

Each end panel 20 is divided into three sections, each substantially rectangular in shape. Adjacent the base panel 13 is first end section 22 which is joined along fold line 30 to second end section 25 which, in turn is joined along fold line 33 to third end section 28. Third end section 28 terminates in end edge 40. Fold lines 18, 30 and 33 and end edge 40 are all substantially mutually parallel.

In the preferred embodiment, shown in FIGS. 1–5, each third end section 28 has two lock tabs 35,35, one at each side edge of the section, foldably joined along fold lines 38,38. These lock tabs engage into openings 43,43 which are properly positioned in side panels 50,50 for their reception.

Each side panel 50 is made up of a first substantially rectangular side section 53 having two triangular side flaps 55,55 foldably connected thereto along flap lines 58,58. Foldably connected to each side section 53 along join line 62 is a second substantially rectangular side section 60. Each second side section 60 terminates in side edge 65. Fold lines 15 and 62 and side edge 65 are all essentially mutually parallel.

The positioning of the decorative wrap decorative wrap 80 is more clearly indicated in FIG. 2. The decorative wrap 80 is generally rectangular in shape and, in the preferred embodiment, shorter in all dimensions than the paperboard blank. The wrap is attached using adhesive, as is well known in the art, (as indicated in region 88) to each second side section 60 and each second end section 25. This results in an unmated section 82 of decorative wrap extending beyond the hypotenuse 90 of each triangular side flap 55. This unmated section 82 is adhesively joined to the first 22 and second 25 end sections of the paperboard blank 11.

Figure 4:
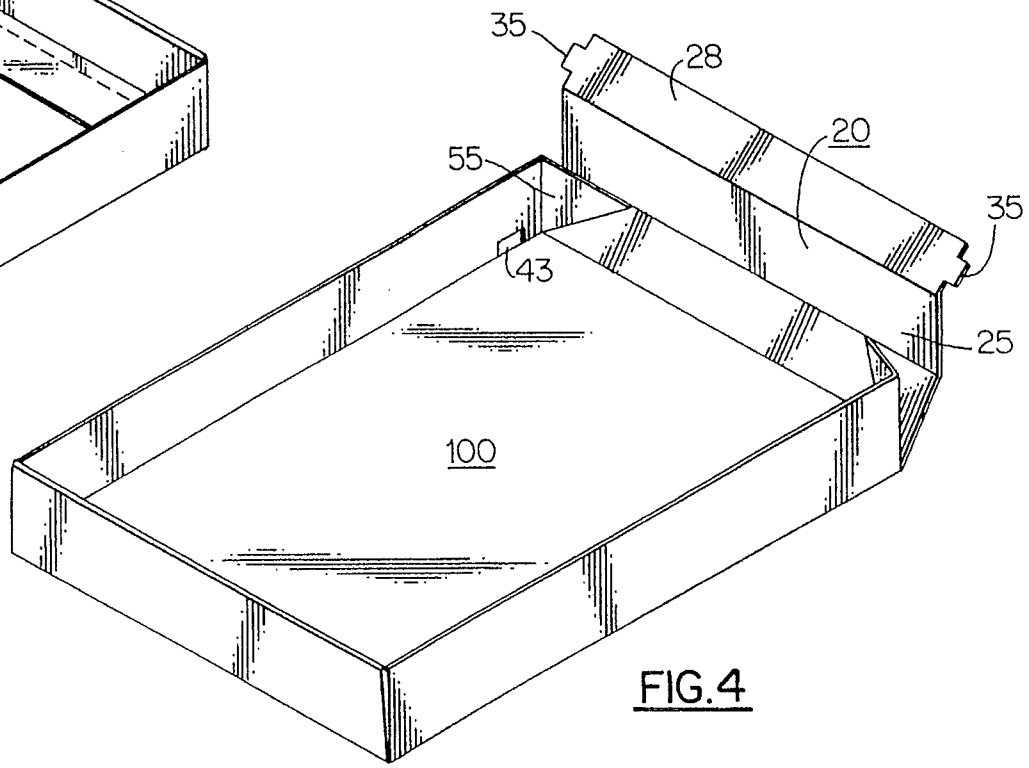
FIG. 4 is a perspective view of the box of FIG. 2 illustrating the manner in which a box can be formed therefrom.
Figure 3:
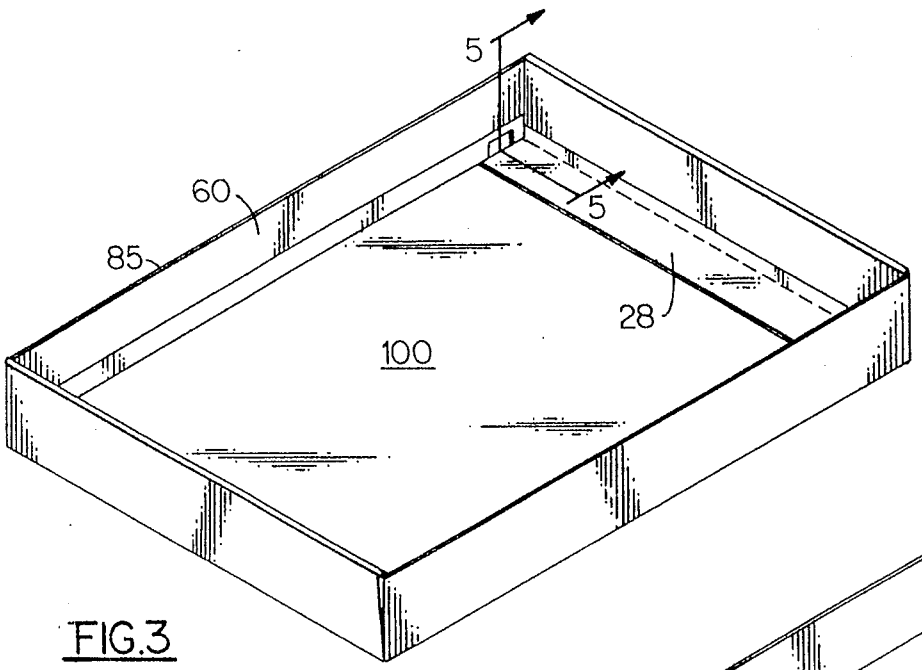
FIG. 3 is a perspective view of the fully erected box of FIG. 2.

The preferred embodiment is set up as indicated in FIG. 4 by folding the end panels 20,20 upward along fold lines 18,18, folding second panels 25,25 down over and parallel to first panels 22,22 along fold lines 30,30 and folding third panels 28,28 along fold lines 33,33 so that they lie parallel to and flat against base panel 13. The order in which these folding operations are performed is not critical and scoring and/or perforations along the fold lines can allow all three folding operations to be performed simultaneously for a very fast set-up. No matter in which order the folds are made, in the final set up product, triangular side flaps 55 are each sandwiched between one first end segment 22 and its adjoining second end segment 25. Also half the rectangle which is folded along edge 90 of each triangular side flap 55 as diagonal, is comprised only of the decorative paper 96. This allows the fold to be made more easily, and also produces less intermediate bulk as the that needs to be tucked into the folded end panel. Lastly tab locks 35,35 which may at any time be folded along lines 38,38 are slipped into receptacles 43,43. As can be seen from the set-up box in FIG. 3, this configuration not only allows speedy set-up but also results in both a decorative edge 88 and an apparently unbroken line of decorative paper across the inside of the box, lending an elegant appearance to the box. The plain, undecorated paperboard shows only as the base panel and a constant fraction of the visible portion of both the side and end panels.

Figure 5:
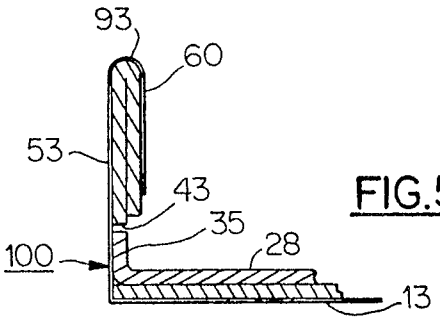
FIG. 5 is a fragmentary, vertical, sectional view taken on line 5—5 of FIG. 3.
Figure 7:
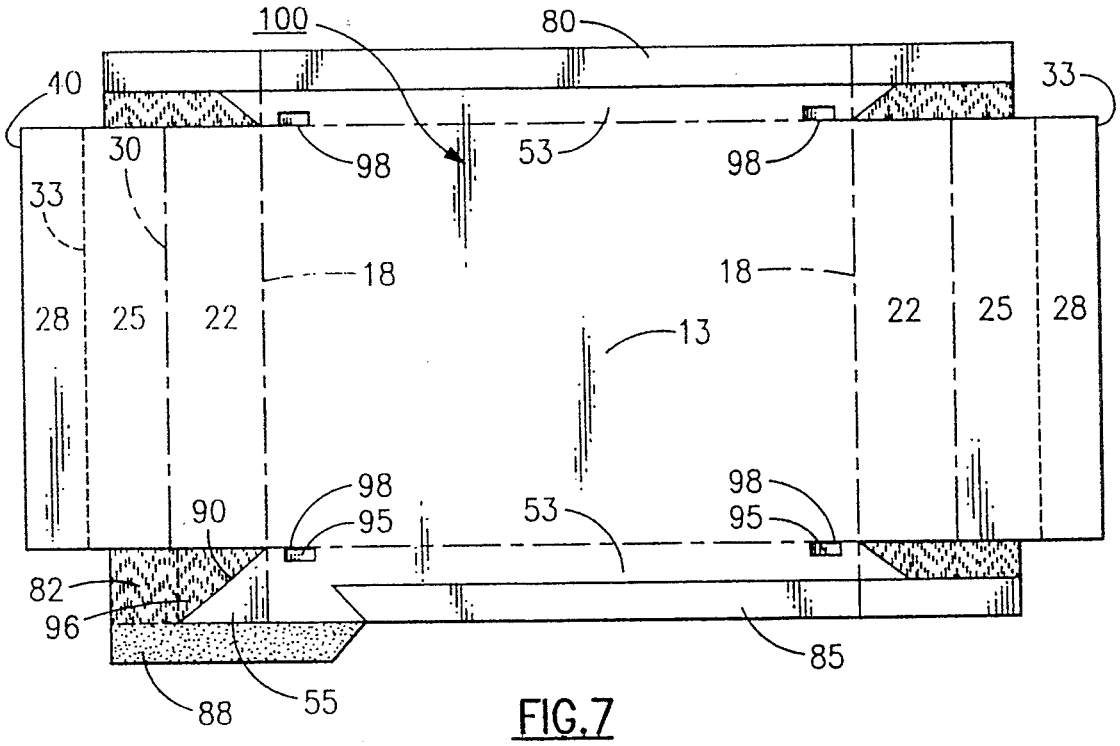
FIG. 7 is a plan view of foldable paperboard of FIG. 6 with a portion of the flexible decorative material attached thereto cut away.
Figure 6:
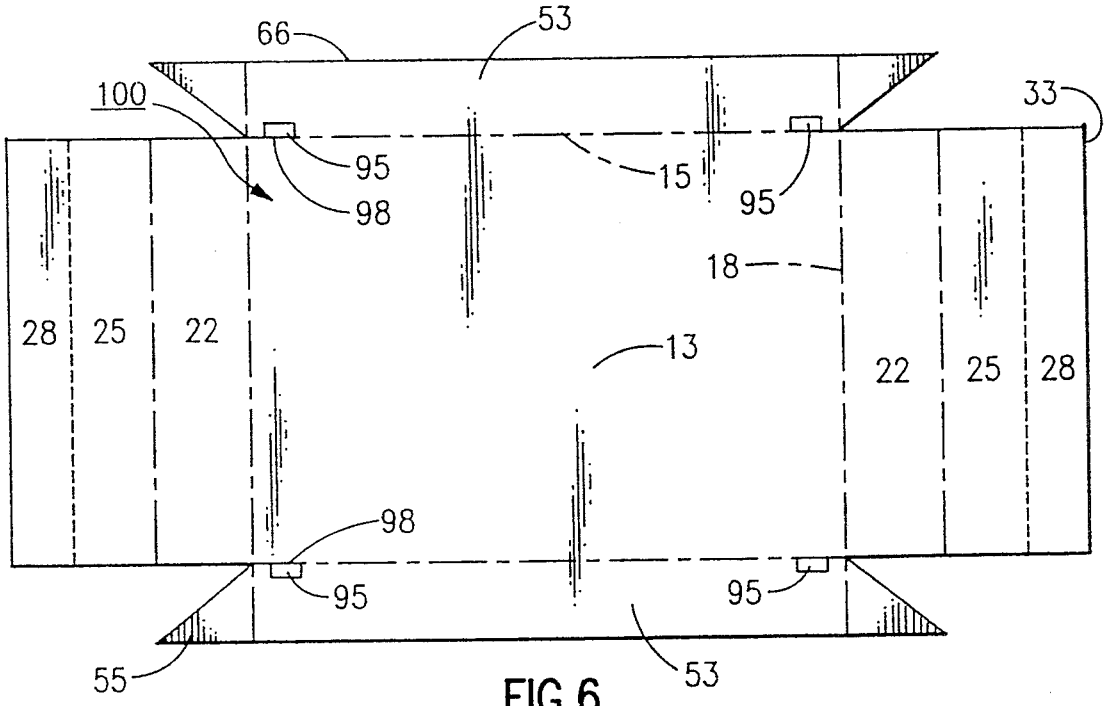
FIG. 6 is a plan view of a second embodiment of foldable paperboard cut for use in forming a box member embodying features of the present invention.
Figure 9:
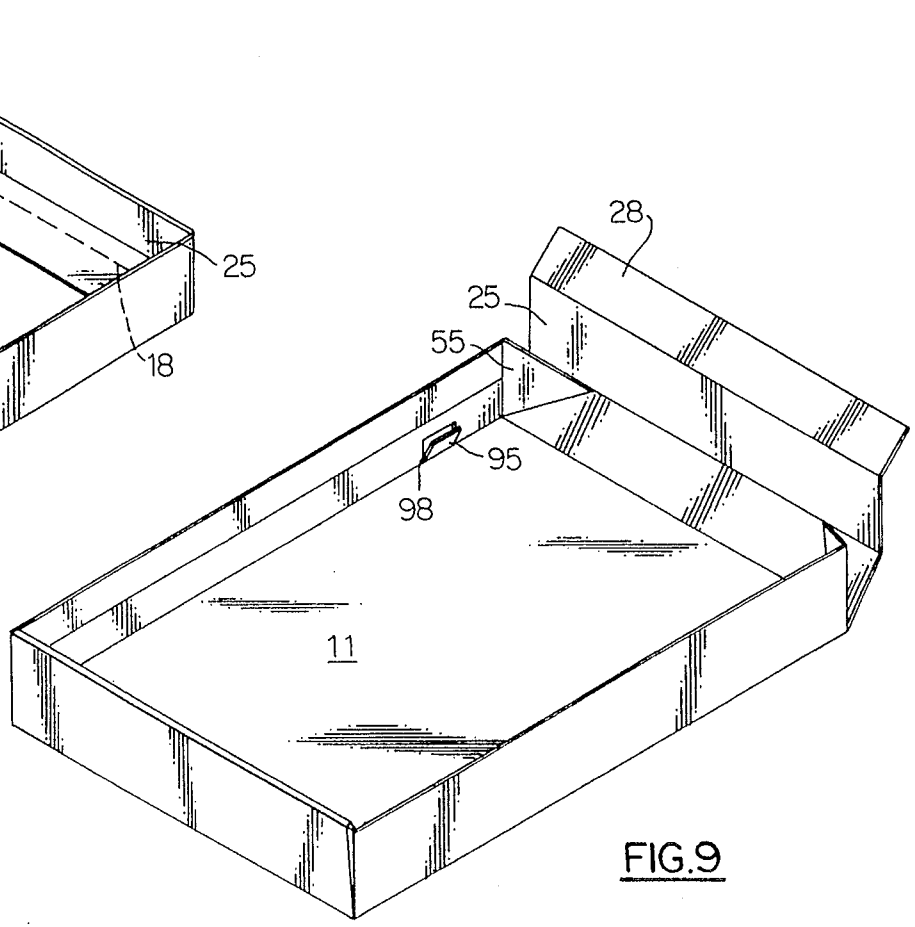
FIG. 9 is a perspective view of the box of FIG. 7 illustrating the manner in which a box can be formed therefrom.
Figure 8:
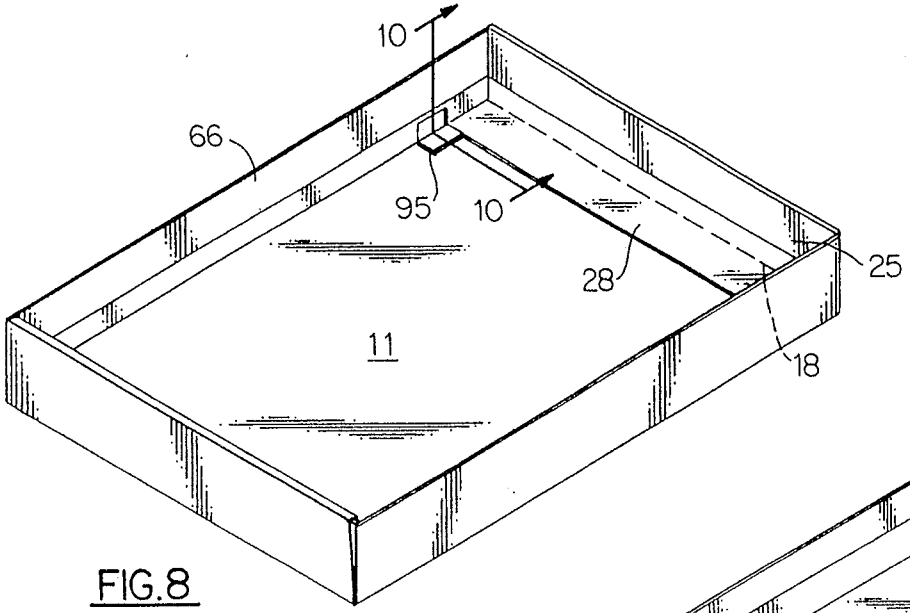
FIG. 8 is a perspective view of the fully erected box of FIG. 7.
Figure 10:
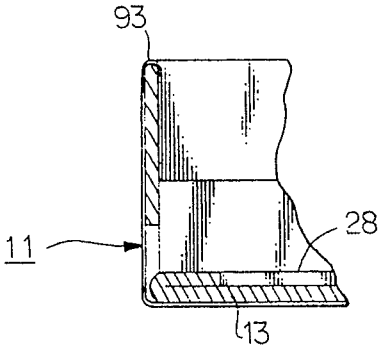
FIG. 10 is a fragmentary, vertical, sectional view taken on line 10—10 of FIG. 8.

This elegance is not obtained at the expense of durability, however for, as can be seen in FIGS. 4 and 5 there are three layers of paperboard at the assembled corners and each exposed edge has four layers, two of the folded paperboard and two of the folded paper.

An alternative embodiment is shown generally as box 100 in FIGS. 6–10, with like parts numbered with like numerals. The paperboard blank of this embodiment differs from that of the preferred embodiment in a number respects. First, each side panel 50 is made up of only a single substantially rectangular side section 53 having two triangular side flaps 55,55 foldably connected thereto along join lines 58,58. Each side panel terminates in side edge 66. The decorative paper 80, in this case, is wider than the paperboard blank 100 and folds over side edge 66 to form the decorative edging 93.

In addition, in the alternative embodiment, the third end panel 28 does not contain any lock tabs. Rather, lock tabs are formed by cutting two groups of three slashes into each of the side panels 50, freeing rectangular lock tabs 95,95 which are foldably attached to panels 50 along fold lines 98,98. The lock tabs 95,95 are then adhesively attached to the base panel 13 so that each end edge 40 abuts against two lock tabs 95,95, thus retaining the end panels 20,20 in their set up position.

While this invention has been explained with reference to the structures disclosed herein, it is not confined to the details set forth. In particular many other methods of retaining paperboard in position are known in the art including barbed tabs, slots, and lock tabs set into various of the panels, and of which may be used with a structure having triple rectangular section end panels and a rectangular side section with triangular side flaps. This application is intended to cover any modifications and changes as may come within the scope of the following claims.

What is claimed is:

1. A box member for a folding box of a type having a pair of telescoping box sections said box member being formed from a composite blank including a sheet of foldable stiff material and a sheet of flexible material attached to said stiff sheet, said stiff material forming a first surface and said flexible material forming a second surface, said box member comprising:

a base panel having a pair of opposed side edges and a pair of opposed end edges;

a pair of end panels, each said end panel having a first section connected to one of said pair of opposed end edges of the base panel, a third section defined by a free edge and a second section that is intermediate said first section and said third section and connected along a first fold line to said first section and along a second fold line to said third section, said free edge, said end edge, said first fold line and said second fold line all being mutually parallel;

a pair of side panels, each said side panel having no more than two sections, and each said side panel having a section connected to one of said side edges of the base panel along a side fold line, and having a side panel side edge;

a flap attached to each end of each of said side panels along a flap fold line, each said flap being folded along said flap fold line so that it rests against said first and said second sections of one of said end panels and is sandwiched therebetween; and retaining means for retaining said third section of said end panel against a first surface of said base panel.

2. A box member according to claim 1 wherein said flexible material is decorative.

3. A box member according to claim 1 wherein said flaps are each essentially triangular in shape.

4. A box member according to claim 3 wherein each of said triangular flaps is comprised of both stiff material and flexible material and each of said triangular flaps comprises half of a rectangle, said rectangle having as a second half thereof flexible material only.

5. A box member according to claim 4 wherein each of said side panels comprises a first section and a second section, foldably joined along a third fold line.

6. A box member according to claim 5 wherein said retaining means comprises:

a pair of lock tabs, each lock tab being foldably joined along a first tab fold line to one of said end panel, each of said lock tabs being situated at one side edge of each of said third sections of said end panels, and said side panels each having openings adjacent the end edges thereof for receiving said lock tabs.

7. A box member according to claim 4 wherein each of said side panels has a free edge of the flexible material extending beyond a free edge of the stiff material, said free edge of flexible material being folded over said free edge of said stiff material, to produce a free box edge covered with flexible material.

8. A box member according to claim 7 wherein said retaining means comprises four lock tabs, each individual said lock tab being foldably joined along a second tab fold line, each of said lock tabs extending outwardly between said base panel and one of said side panels, and adhesively affixed to said base panel at a position so that the third section of each of said end panels abuts against two of said lock tabs.

9. A box member according to claim 4 wherein said second surface of said flexible material forms an essentially continuous appearing line across an inside perimeter of said box.

* * * * *